US008483892B2

(12) United States Patent
Gaile et al.

(10) Patent No.: US 8,483,892 B2
(45) Date of Patent: Jul. 9, 2013

(54) METHOD FOR LIMITING THE ANGLE BETWEEN THE LONGITUDINAL AXES OF CAR BODIES THAT ARE CONNECTED TO EACH OTHER

(75) Inventors: Anton Gaile, Leutkirch (DE); Thomas Nickl, Treuchtlingen (DE); Friedrich Vemmer, Fürth (DE)

(73) Assignee: Siemens Aktiengesellschaft, Munich (DE)

( * ) Notice: Subject to any disclaimer, the term of this patent is extended or adjusted under 35 U.S.C. 154(b) by 559 days.

(21) Appl. No.: 12/743,304

(22) PCT Filed: Nov. 4, 2008

(86) PCT No.: PCT/EP2008/064910

§ 371 (c)(1), (2), (4) Date: May 17, 2010

(87) PCT Pub. No.: WO2009/062859

PCT Pub. Date: May 22, 2009

(65) Prior Publication Data

US 2010/0270254 A1 Oct. 28, 2010

(30) Foreign Application Priority Data

Nov. 16, 2007 (DE) ..... 10 2007 054 861

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |
| *B61C 11/00* | (2006.01) |
| *B61C 13/00* | (2006.01) |
| *B61F 5/38* | (2006.01) |

(52) U.S. Cl.
USPC ..... 701/19; 701/41; 105/1.4; 105/4.2; 105/4.4; 105/34.1

(58) Field of Classification Search
USPC ..... 701/19, 41; 105/1.4, 4.2, 4.4, 34.1
See application file for complete search history.

(56) References Cited

U.S. PATENT DOCUMENTS

| | | | | |
|---|---|---|---|---|
| 4,135,453 | A * | 1/1979 | Koch et al. | 105/131 |
| 4,640,198 | A * | 2/1987 | Haupl | 105/168 |
| 5,488,910 | A * | 2/1996 | Pees et al. | 105/166 |
| 5,640,910 | A * | 6/1997 | Pouyt et al. | 105/168 |
| 5,732,789 | A * | 3/1998 | Stephenson | 180/418 |
| 6,038,981 | A * | 3/2000 | Daberkow et al. | 105/168 |
| 6,161,064 | A | 12/2000 | Strasser et al. | |
| 6,244,190 | B1 * | 6/2001 | Sembtner et al. | 105/199.2 |
| 6,247,510 | B1 * | 6/2001 | Diekhans et al. | 141/231 |
| 6,401,627 | B1 * | 6/2002 | Fehrenbach et al. | 105/182.1 |
| 6,418,859 | B1 | 7/2002 | Hentschel et al. | |
| 6,484,074 | B1 * | 11/2002 | Hazard et al. | 701/19 |
| 6,910,426 | B2 * | 6/2005 | Krishnaswami | 105/167 |
| 2003/0230213 | A1 * | 12/2003 | Schaller et al. | 105/168 |
| 2005/0148396 | A1 * | 7/2005 | Lindethal | 464/112 |
| 2005/0183625 | A1 * | 8/2005 | Goding et al. | 105/182.1 |
| 2009/0276107 | A1 * | 11/2009 | Reimann et al. | 701/19 |
| 2010/0229753 | A1 * | 9/2010 | Kikko et al. | 105/4.4 |
| 2010/0326317 | A1 * | 12/2010 | Simson | 105/168 |
| 2011/0253003 | A1 * | 10/2011 | Rodet et al. | 105/34.1 |

FOREIGN PATENT DOCUMENTS

| | | | |
|---|---|---|---|
| CA | 2225040 | A1 | 11/1997 |
| DE | 2060231 | A1 | 6/1972 |
| DE | 2123876 | A1 | 11/1972 |
| DE | 2854776 | A1 | 7/1980 |
| DE | 19543172 | C1 | 5/1997 |
| DE | 19712752 | A1 | 10/1998 |
| DE | 19861086 | A1 * | 1/2000 |
| DE | 19936565 | A1 | 2/2001 |
| EP | 0774394 | A2 | 5/1997 |
| EP | 1074449 | A1 | 2/2001 |
| EP | 0969997 | B1 | 10/2001 |
| EP | 0877694 | B1 | 3/2002 |
| RU | 2143356 | C1 | 12/1999 |

OTHER PUBLICATIONS

DE 19712752 machine language translation, Jan. 12, 2000.*
DE 2854776 machine language translation, Jul. 17, 1980.*
Isao Koamoto, "How Bogies Work", Japan Railway & Transport Review 18, all pages, Dec. 1998.*
"Damping", Wikipedia, all pages, date unknown.*
William Strunk Jr. and E.B. White, The Elements of Style, 3rd Ed., all pages, 1979.*
DE19861086 machine language translation, Jan. 27, 2000.*

* cited by examiner

*Primary Examiner* — Calvin Cheung
(74) *Attorney, Agent, or Firm* — Laurence A. Greenberg; Werner H. Stemer; Ralph E. Locher

(57) ABSTRACT

A method for limiting the angle between the longitudinal axes of car bodies of a multi-part rail vehicle connected to each other via a joint, wherein each car body is supported on only one bogie. The angle is actively influenced by an electrically controlled activation member connected to the joint, until the angle assumes a setpoint value. The setpoint value is determined from the pivot angles (relative angles) of the bogies relative to the associated car bodies.

25 Claims, No Drawings

METHOD FOR LIMITING THE ANGLE BETWEEN THE LONGITUDINAL AXES OF CAR BODIES THAT ARE CONNECTED TO EACH OTHER

BACKGROUND OF THE INVENTION

Field of the Invention

The invention relates to a method for limiting the angle between the longitudinal axes of car bodies of a multi-part rail vehicle, each car body being connected to one another via a joint, in which each car body is supported on only one bogie.

A multi-part rail vehicle is known, for example, from DE 21 23 876 A. It is important in said "articulated car" that the structure gauge is not infringed when travelling around a curve. For this purpose, a joint is assigned two hydraulic cylinders which are connected to a hydraulic fluid line. This prevents the car parts from buckling excessively with respect to one another.

EP 0 877 694 B1 discloses a supplementary method for influencing the buckling angle between interconnected car bodies. In this case, the profile of the track to be travelled over by the rail vehicle must be detected and depicted. The buckling angle between adjacent car bodies is then changed by an actuator as a function of the track in such a manner that the structure gauge is not infringed.

The known methods for limiting the angle between the longitudinal axes of car bodies that are connected to each other are either not sufficiently reliable or highly complicated.

BRIEF SUMMARY OF THE INVENTION

The invention is based on the object of indicating a method for limiting the angle between the longitudinal axes of the car bodies, said method making it possible with a high degree of accuracy and without complicated method steps, for example the detecting of a track, for a multi-part rail vehicle, in which the car bodies are each supported only on one bogie, to be able to travel around tight curves without infringing the structure gauge.

The object is achieved according to the invention in that the angle is actively influenced by an electrically controlled activation member, which is connected to the joint, until said angle assumes a target value, and in that said target value is determined from the pivot angles (relative angles) of the bogies relative to the associated car bodies.

The advantage obtained with this method is that use is made of an electrically controlled activation member which particularly reliably limits the angle between the car bodies and that a complicated detection of the track is not necessary to control said activation member. It is therefore possible with simple means to reliably hold a multi-part rail vehicle, in which each car body is supported on only one bogie, in the structure gauge even during tight curves or tight sequences of bends. Damage due to collision with appliances arranged outside the structure gauge cannot occur.

For example, the joint is a single joint, and the target value is determined as a value in which the difference of the relative angles between bogie and car body is zero for the connected car bodies. The angle between the car bodies is therefore reliably limited.

According to another example, the joint is a double joint with two perpendicular axes of rotation spaced apart in the longitudinal direction of the rail vehicle, and the target value is determined as a value in which the relative angle between bogie and car body is zero at at least one of the connected car bodies. It may be sufficient only to consider one of the interconnected car bodies and its bogie in this case.

For example, the double joint is part of a car body which does not have a bogie (sedan-type module). In this case, one perpendicular axis of rotation is arranged upstream of the sedan-type module and the other perpendicular axis of rotation is arranged downstream of the sedan-type module in the longitudinal direction of the rail vehicle. As in the case of the simple double joint, only the relative angle between bogie and car body is considered by way of one of the car bodies connected by the sedan-type module.

For example, the rail vehicle is in three parts, and the target value is determined as a value in which the relationship is $C_1 \cdot \gamma_1 + C_2 \cdot \gamma_2 + C_3 \cdot \gamma_3 = 0$, where $C_1$, $C_2$ and $C_3$ are freely selectable constants and $\gamma_1$, $\gamma_2$ and $\gamma_3$ are the relative angles between bogie and car body at the three car bodies.

A corresponding calculation is also correspondingly possible for four-part and even longer multi-part rail vehicles.

With the methods referred to previously, multi-part rail vehicles which have, for example, two, three, four, five, six, seven or eight car bodies can advantageously be constructed.

For example, the force acting on the joint is measured and incorporated into the control of the activation member, and if said force changes the angle away from the target value, the activation member is blocked or remains blocked. This gives rise to the particular additional advantage that the joint does not have to move in order to recognize that it is not moving to an undesirable angle. Excessive buckling of adjacent car bodies with respect to each other even under the action of static forces is reliably prevented.

For example, the force is limited by a pressure-limiting valve in the activation member such that the bogies cannot be derailed.

For example, the activation member is blocked for a limited time. An excessively long stoppage of the activation member cannot occur. Errors are reduced.

For example, only a change in the angle in the direction leading away from the target value is prevented by blocking of the activation member, and a change in the angle in the opposite direction is not restricted. This substantially simplifies regulation.

For example, the movement of the activation member is limited spatially and/or in terms of time. This prevents the angle from becoming of a size such that the structure gauge is infringed or the rail vehicle is even derailed.

For example, the kinetic energy and/or the potential energy of the spring suspension of the rail vehicle is used to set the angle. This affords the particular advantage that an external auxiliary energy is not required to set the angle.

For example, external auxiliary energy is used to set the angle. This affords the advantage that the angle remains the same even when the vehicle is not moving (statically acting forces). Said auxiliary energy can come from the towing vehicle during towing.

For example, the auxiliary energy is used as a function of the travelling states and/or the vehicle configuration.

For example, the activation member is blocked or the movement of the activation member is limited (damped) as a function of the travelling speed and/or other travelling states of the rail vehicle. This is because undesirable movements of the car bodies can occur at a high speed. It may be expedient to limit (damp) the movement of the activation member, for example above a speed of 60 km/h.

The activation member is blocked, for example, during emergency braking and/or during towing. In particular during emergency braking, excessively large angles between the car bodies are thereby avoided.

The magnitude of a permissible deviation of the angle from the target value is changed, for example, as a function of the speed and/or state of the rail vehicle. This prevents the angle from being actively changed too frequently at, for example, a high speed or, for example, during towing. The angle is prevented from changing within short time intervals.

The activation member is designed, for example, as an electromechanical and/or pneumatic and/or hydraulic and/or electrohydraulic activation drive.

For example, the angle is influenced by two electrohydraulic activation drives with a differential cylinder.

All of these embodiments of activation members are readily suitable in the same manner.

For example, the activation drive of the activation member comprises a chamber with a piston which is moveable therein.

For the blocking or limiting (damping), the chamber is, for example, entirely or partially closed. The desired blocking or limiting can be carried out particularly simply in this manner.

For example, for the blocking of the angle, either only the piston chambers, only the annular chambers or the piston chambers and the annular chambers are shut off, thus producing differing stiffnesses of the medium in the activation drive.

The chamber is connected, for example, to a feed pump for the supply of external auxiliary energy. Hydraulic fluid can be fed in with the feed pump.

For example, auxiliary energy is supplied to the activation drive, each time only into the piston chamber or annular chamber, by an electric motor and pump.

The chamber is connected, for example, to a medium tank via a valve. Said medium tank can contain the required hydraulic fluid.

The activation member is moved between the piston chamber and/or annular chamber, on the one hand, and the medium tank, on the other hand, by means of a suction follow-up valve, and by means of a switching or proportional valve which serves to unload the cylinder chambers into the medium tank.

For example, to limit (damp) the movement of the activation member, the latter is connected to valves which are changeable in fixed stages and/or to proportional valves. Valves of this type are advantageously readily suitable to control the inflow of hydraulic fluid.

The method according to the invention for limiting the angle between the longitudinal axes of car bodies connected to each other in particular affords the advantage that, in the case of a multi-part rail vehicle, the car bodies of which are each supported on only one bogie, an infringement of the structure gauge in curves is prevented with simple means.

The invention claimed is:

1. A method for limiting an angle between longitudinal axes of car bodies of a multi-part rail vehicle, wherein each car body is connected to another car body via a joint and in which each car body is supported on only one bogie, the method which comprises:

actively influencing the angle between the longitudinal axes of the car bodies with an electrically controlled activation member, which is connected to the joint, until the angle assumes a setpoint value;

determining the setpoint value from pivot angles (relative angles) of bogies relative to associated car bodies; and measuring a force acting on the joint and incorporating the force into the control of the activation member, and, when the force changes the angle away from the setpoint value, blocking the activation member or keeping the activation member blocked.

2. The method according to claim 1, wherein the joint is a single joint, and the setpoint value is determined as a value in which a difference of the relative angles between bogie and car body is zero for the connected car bodies.

3. The method according to claim 1, wherein the joint is a double joint with two perpendicular axes of rotation spaced apart in longitudinal direction of the rail vehicle, and wherein the setpoint value is determined as a value in which a relative angle between bogie and car body is zero at at least one of the connected car bodies.

4. The method according to claim 3, wherein the double joint is part of a car body which does not have a bogie (sedan-type module), and in that one perpendicular axis of rotation is arranged upstream of the sedan-type module and the other perpendicular axis of rotation is arranged downstream of the sedan-type module in the longitudinal direction of the rail vehicle.

5. The method according to claim 1, wherein the rail vehicle has three car bodies, and the setpoint value is determined as a value in which a relationship is $C_1 \cdot \gamma_1 + C_2 \cdot \gamma_2 + C_3 \cdot \gamma_3 = 0$, where $C_1$, $C_2$ and $C_3$ are freely selectable constants and $\gamma_1$, $\gamma_2$ and $\gamma_3$ are respective relative angles between bogie and car body at the three car bodies.

6. The method according to claim 1, which comprises limiting the force with a pressure-limiting valve in the activation member so that the bogies cannot be derailed.

7. The method according to claim 1, which comprises blocking the activation member for a limited time.

8. The method according to claim 1, which comprises preventing only a change in the angle in a direction leading away from the setpoint value by blocking the activation member, and not restricting a change in the angle in the opposite direction.

9. The method according to claim 1, which comprises limiting a movement of the activation member at least one of spatially or in terms of time.

10. The method according to claim 1, which comprises using external auxiliary energy in setting the angle.

11. The method according to claim 10, which comprises using the auxiliary energy as a function of at least one of travelling states or vehicle configuration.

12. The method according to claim 1, which comprises blocking the activation member or limiting (damping) movement of the activation member as a function of at least one of traveling speed or other travelling states of the rail vehicle.

13. The method according to claim 1, which comprises blocking the activation member at least during emergency braking or during towing.

14. The method according to claim 1, which comprises adjusting a magnitude of a permissible deviation of the angle from the setpoint value as at least one of a function of a speed or a state of the rail vehicle.

15. The method according to claim 1, wherein the activation member is an activation drive selected from the group consisting of electromechanical, pneumatic, hydraulic, and electro-hydraulic activation drives.

16. The method according to claim 15, wherein the activation drive of the activation member comprises a chamber with a piston which is movable therein.

17. The method according to claim 16, which comprises entirely or partially closing the chamber for blocking or limiting (damping).

18. The method according to claim 16, wherein, for blocking of the angle, either only piston chambers, only annular chambers or the piston and annular chambers are shut off, thus producing differing stiffnesses of a medium in the activation drive.

19. The method according to claim 16, wherein the chamber is connected to a feed pump for supplying external auxiliary energy.

20. The method according to claim 16, which comprises supplying auxiliary energy to the activation drive, each time only into the chamber with the piston or an annular chamber, with an electric motor and pump.

21. The method according to claim 16, wherein the chamber is connected to a medium tank via a valve.

22. The method according to claim 21, which comprises moving the activation member between at least one of the chamber with the piston an annular chamber, on the one hand, and the medium tank, on the other hand, by way of a suction follow-up valve, and by way of a switching or proportional valve serving to unload the chamber into the medium tank.

23. The method according to claim 1, wherein the angle is influenced by two electro-hydraulic activation drives with a differential cylinder.

24. The method according to claim 1, which comprises limiting (damping) a movement of the activation member by connecting the activation member to valves that are changeable at least one of in fixed stages or to proportional valves.

25. A method for limiting an angle between longitudinal axes of car bodies of a multi-part rail vehicle, wherein each car body is connected to another car body via a joint and in which each car body is supported on only one bogie, the method which comprises:

actively influencing the angle between the longitudinal axes of the car bodies with an electrically controlled activation member, which is connected to the joint, until the angle assumes a setpoint value;

determining the setpoint value from pivot angles (relative angles) of bogies relative to associated car bodies; and using at least one of a kinetic energy or a potential energy of a spring suspension of the rail vehicle in setting the angle.

* * * * *